US005958862A

United States Patent [19]

Hemm et al.

[11] Patent Number: 5,958,862

[45] Date of Patent: Sep. 28, 1999

[54] WATER CONTAINING PASTE-FORM DETERGENT COMPOSITION BASED ON SODIUM HYDROXIDE

[75] Inventors: Dieter Hemm; Guenter Hellmann, both of Hilden; Klaus Wilbert; Horst Pruehs, both of Duesseldorf, all of Germany

[73] Assignee: Henkel-Ecolab GmbH & Co. OHG, Duesseldorf, Germany

[21] Appl. No.: 08/894,951

[22] PCT Filed: Feb. 27, 1996

[86] PCT No.: PCT/EP96/00792

§ 371 Date: Oct. 6, 1997

§ 102(e) Date: Oct. 6, 1997

[87] PCT Pub. No.: WO96/27653

PCT Pub. Date: Sep. 12, 1996

[30] Foreign Application Priority Data

Mar. 3, 1995 [DE] Germany ..... 195 07 532

[51] Int. Cl.[6] ..... C11D 17/00; C11D 7/06; C11D 11/00

[52] U.S. Cl. ..... 510/404; 510/221; 510/435; 510/499; 510/505; 510/506

[58] Field of Search ..... 510/404, 435, 510/221, 207, 212, 499, 505, 506; 252/FOR 229, FOR 228, FOR 196, FOR 164, FOR 204

[56] References Cited

U.S. PATENT DOCUMENTS

| | | | |
|---|---|---|---|
| 3,607,764 | 9/1971 | Crotty et al. | 252/139 |
| 3,796,602 | 3/1974 | Briney et al. | 134/38 |
| 3,847,839 | 11/1974 | Murphy et al. | 510/203 |
| 4,801,396 | 1/1989 | Altenschöpfer et al. | 252/99 |
| 5,019,290 | 5/1991 | Bruegge et al. | 252/135 |
| 5,061,392 | 10/1991 | Bruegge et al. | 510/404 |
| 5,510,051 | 4/1996 | Lam | 510/101 |

FOREIGN PATENT DOCUMENTS

| | | |
|---|---|---|
| 31 38 425 | 4/1983 | Germany . |
| 42 28 786 | 3/1994 | Germany . |
| 59-182870 | 10/1984 | Japan . |
| 61-296098 | 12/1986 | Japan . |
| WO94/18301 | 8/1994 | WIPO . |

OTHER PUBLICATIONS

Chemical Abstract 118:43456 (for "Alkaline aqueous solutions in surface cleaning processes. Solutions of sodium hydroxide and monoethanolamine", (Russian journal article) (CA '456)), 1992.

Chernin et al., Aqueous Alkaline Solutions for Cleaning Surfaces. Sodium Hydroxide and Monethanolamine Solutions, Kolloidnyi Zhurnal 54(5):164–68 (1992) (translated).

*Primary Examiner*—Ardith Hertzog
*Attorney, Agent, or Firm*—Ernest G. Szoke; Wayne C. Jaeschke; Glenn E.J. Murphy

[57] ABSTRACT

Transport- and storage-stable paste-form detergents based on sodium hydroxide that are easily processed and handled are obtained by thickening concentrated aqueous sodium hydroxide preparations with glycols, glycol derivatives, alkanolamines, or alkanolamine derivatives. The detergents also can contain builders and other typical detergent composition ingredients.

15 Claims, No Drawings

WATER CONTAINING PASTE-FORM DETERGENT COMPOSITION BASED ON SODIUM HYDROXIDE

BACKGROUND OF THE INVENTION

1. Field of the Invention

This invention relates to water-containing paste-form detergents based on NaOH. To establish the required viscosity, the detergents contain glycols, glycol derivatives and/or certain alkanolamines.

Highly alkaline cleaners are now commercially available in various forms, for example as powders, granules, liquids, fused blocks or tablets.

Each of these forms has specific advantages and disadvantages for a particular application. Powders, granules or liquids have been successfully used for cleaning textile surfaces or for the manual mechanical cleaning of hard surfaces while tablets produced by compression molding or block-form detergents obtained by melting and subsequent cooling (fused blocks) are being increasingly used in addition to powders, granules or liquids for the machine cleaning of hard surfaces, for example for machine dishwashing. Tablets and fused blocks have the advantage over powders of accurate and simple dosing, do not emit any dust and are easy to handle.

These advantages can be utilized, for example, in domestic dishwashing machines, but above all in continuous institutional dishwashing machines where the articles to be cleaned pass through various washing zones.

It has now been found that tablets and fused blocks also have disadvantages. For example, tablets can break. Tablets damaged by breakage naturally no longer have the advantage of accurate dosing. Another problem with tablets is that the required solubility in water cannot always be guaranteed, i.e. tablets occasionally dissolve either too quickly or too slowly. In addition, both tablets and fused blocks require complicated production processes.

2. Discussion of the Related Art

Paste-form detergents have been described in the prior-art literature, for example in DE-OS 31 38 425. The rheological behavior of the detergents described in this document is gauged in such a way that a gel-like paste can be liquefied by application of mechanical forces, for example by shaking or squeezing, to a deformable storage container or tube or by means of a metering pump and can readily be expressed from a spray nozzle.

In the document in question, silicates are primarily used as alkali carriers whereas the detergents according to the present invention are intended to be paste-like and to be based on the very inexpensive raw material, sodium hydroxide, as the alkali carrier.

One of the difficulties of producing paste-form highly alkaline NaOH-containing detergents is that many thickeners are either not permanently alkali-stable, so that their thickening effect diminishes, or are unsuitable for economic reasons.

U.S. Pat. No. 3,607,764 describes solid glass cleaners which can be diluted to form a sprayable solution. The cleaners in question contain inter alia sodium or potassium hydroxide, sodium or potassium tripolyphosphate, sodium or potassium pyrophosphate, hydroxycarboxylic acid builders, a water-soluble nonionic surfactant, alkylene glycol ether and optionally sodium carbonate. There is no reference to a paste-like consistency on the lines of the present invention.

JA 84/182870 describes solutions of small quantities of alkali metal hydroxides (below 2% by weight) in glycols or alcohols which become viscous by neutralization with long-chain carboxylic acids, have a pH value in the range from 7 to 11 and may be used as a paste in the oiling of leather by addition of silicone oil.

JA 86/296098 describes a solid detergent containing caustic alkali, preferably LiOH, NaOH, KOH, mixed with alkanolamine and polyethylene glycol in specific ratios by weight, so that a solid detergent with a dry surface is obtained. This solid aggregate state also prevents the phase separation of polyethylene glycol.

DESCRIPTION OF THE INVENTION

The problem addressed by the present invention was to provide water-containing, highly alkaline, NaOH-based general-purpose detergents for textile surfaces, for example butcher's overalls, but preferably for cleaning hard surfaces, for example dishes, and more preferably for institutional dishwashing which would combine the advantages of powders and liquids on the one hand with the advantages of tablets and fused blocks on the other hand. In other words, the invention set out to provide detergents which would have exactly defined solubility under various conditions of use, but which on the other hand would be stable both during transportation and in storage and, in addition, would lend themselves to fast, simple and accurate dosing, would not emit any dust and could be produced without significant outlay on machinery.

The detergents would of course also satisfy the usual requirements, i.e. would show high cleaning performance, fat-dissolving power, etc.

The present invention relates to water-containing highly alkaline paste-form detergents containing a) sodium hydroxide in a quantity of 15 to 50% by weight and preferably 28 to 40% by weight, b) water in a quantity of 16 to 55% by weight and preferably 28 to 40% by weight, c) a compound corresponding to formula I:

$$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH(R^3)OR^4$ or a group $CH_2CH(R^5)OCH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups, and/or compounds corresponding to formula II:

$$[HOCH_2CH(R^8)]_{3-x}NH_x \quad (II)$$

in which $R^8$ is a hydrogen atom or a methyl group and x is one of the numbers 0, 1 or 2, in a total quantity of 0.5 to 40% by weight and preferably 1 to 10% by weight (all percentages by weight based on the detergent as a whole), characterized in that the detergent has a viscosity at 20° C. of 15,000 to more than 800,000 mPa·s, preferably in the range from 15,000 to 800,000 mPa·s and more preferably in the range from 60,000 to 250,000 mPa·s, as measured with a Brookfield Model DV-II viscosimeter with a spindle corresponding to the particular viscosity at 5 revolutions per minute, the viscosity being read off over a period of 165 to 180 seconds after the beginning of the measurement, and in that the detergent has a pH value of at least 11.5.

The paste-form consistency of the detergent according to the invention is reflected in the fact that it will not flow out from a container, for example a screw-top glass container, at 20° C. without exposure beforehand to shear forces. The paste-form consistency of the detergent according to the invention may even be reflected in the form of resistance to cutting.

Viscosity is measured in the manner described above. The following spindles are used for measuring the viscosities at the defined rotational speed of 5 r.p.m.:

spindle 3: viscosity range from 2,000 to 20,000 spindle 4: viscosity range from 4,000 to 40,000 spindle 5: viscosity range from 8,000 to 80,000 spindle 6: viscosity range from 20,000 to 200,000 spindle 7: viscosity range from 80,000 to 800,000

Where more than one spindle is available for viscosity measurement, it is preferred to use that spindle with which the viscosity value indicated by the viscosimeter is closest to the middle of the scale range.

If, under the conditions mentioned above, the viscosity of a paste-form detergent according to the invention is above the measurement limit of 800,000 mPa·s of the viscosimeter used, the viscosity measurement is carried out at 35° C. Detergents according to the invention have a viscosity at 35° C. (under otherwise the same measuring conditions) of up to 300,000 mPa·s and preferably 200,000 mPa·s.

The coordination of all features with one another in accordance with the invention is crucial to achieving the required paste-form consistency.

For example, it has been found that the solid mixtures described in U.S. Pat. No. 3,607,764 cannot be converted into paste-form detergents according to the invention with the required rheological properties just by gradual dilution with water. The compounds corresponding to formula I or formula II are essential in that they produce the actual thickening to the required paste-form consistency. In the absence of the compounds corresponding to formula I or formula II, detergents with the required viscosity properties cannot be obtained. Either one or more compounds corresponding to formula I or one or more compounds corresponding to formula II or mixtures of compounds corresponding to formulae I and II are present. The compounds corresponding to formulae I and II are preferably selected from the group consisting of ethylene glycol, 1,2-propylene glycol, butyl glycol and butyl diglycol or from the group consisting of ethanolamine, diethanolamine, triethanolamine. 1,2-Propylene glycol and diethanolamine are particularly preferred. However, these compounds should also not be present in larger percentages by weight than the NaOH, i.e. the ratio by weight of the sum of all the compounds corresponding to formulae I and/or II present to the NaOH present is always below 1.

Conversely, no additives other than I and/or II are—surprisingly—necessary to obtain a thickening effect in aqueous sodium hydroxide providing the overall composition is selected in accordance with the invention.

It has also been found that the introduction of NaOH into alcohols does not produce a paste-form consistency. Another remarkable factor is that NaOH cannot readily be replaced by KOH without the consistency of the detergent deviating from the viscosity properties according to the invention.

Finally, the water content is another critical parameter, lying between 16 and 55% by weight and advantageously between 28 and 40% by weight.

The water content also includes the water present in bound form in other ingredients optionally present. Accordingly, the percentages by weight of all other ingredients are always based on the water-free active substance.

A suitable process for producing detergents according to the invention is described in detail hereinafter.

In view of the high NaOH content, the pH value of the detergents according to the invention is above 11.5 and preferably above 13.

The detergents may optionally contain a builder in a quantity of up to 60%, preferably 50% by weight and more preferably in a quantity of 15 to 40% by weight.

The builder present in the detergents according to the invention may in principle be any substance which is known in the prior art as a builder suitable in the broadest sense for detergents and cleaners, water-soluble builders preferably being used.

Suitable builders are, for example, alkali metal phosphates which may be present in the form of their sodium or potassium salts. Examples of such builders are tetrasodium diphosphate, pentasodium triphosphate, so-called sodium hexametaphosphate and the corresponding potassium salts or mixtures of sodium hexametaphosphate and the corresponding potassium salts or mixtures of sodium and potassium salts. Other possible water-soluble builder components are, for example, organic polymers of native or synthetic origin, above all polycarboxylates. Examples of such water-soluble builder components are polyacrylic acids and copolymers of maleic anhydride and acrylic acid and the sodium salts of these polymer acids. Commercially available products are, for example, Sokalan® CP 5 and PA 30 (BASF), Alcosperse® 175 and 177 (Alco), LMW® 45 N and SP02 ND (Norsohaas).

Aminoacetates, for example nitrilotriacetate or ethylenediamine tetraacetate, are also mentioned. Other builders suitable for the purposes of the invention are soda and borax.

Suitable native polymers include, for example, oxidized starch (for example DE 42 28 786) and polyamino acids, such as polyglutamic acid or polyaspartic acid, for example as manufactured by Cygnus, Bayer, Rohm & Haas, Rhône-Poulenc or SRCHEM. Other possible builder components are naturally occurring hydroxycarboxylic acids such as, for example, monohydroxy and dihydroxysuccinic acid, α-hydroxypropionic acid, citric acid, gluconic acid and salts thereof. Citrates are preferably used in the form of trisodium citrate dihydrate.

Other suitable builders are amorphus metasilicates or layer silicates. Crystalline layer silicates are also suitable builders providing they are sufficiently alkali-stable; crystalline layer silicates are marketed by Hoechst AG (Germany) under the generic name Na-SKS, for example Na-SKS-1 ($Na_2Si_{22}O_{45}.xH_2O$, Kenyait), Na-SKS-2 ($Na_2Si_{14}O_{29}.xH_2O$, Magadiit), Na-SKS-3 ($Na_2Si_8O_{17}.xH_2O$), Na-SKS4 ($Na_2Si_4O_9.xH_2O$, Makatit), Na-SKS-5 ($\mu$-$Na_2Si_2O_5$), Na-SKS-7 ($\beta$-$Na_2Si_2O_5$, Natrosilit), Na-SKS-11 ($\tau$-$Na_2Si_2O_5$) and Na-SKS6 ($\delta$-$Na_2Si_2O_5$).

Particularly preferred builders are those selected from the group consisting of pentasodium triphosphate, trisodium citrate, nitrilotriacetate, ethylenediamine tetraacetate and mixtures thereof.

The detergents according to the invention may also contain typical bleaching agents. These typical bleaching agents may be selected from the group of bleaching agents based on oxygen, for example sodium perborate (even in the form of its hydrates) or sodium percarbonate, or from the group of bleaching agents based on chlorine, such as trichloroisocyanuric acid, alkali metal dichloroisocyanurates, alkali metal hypochlorites and formulations designed to release alkali metal hypochlorites, alkali-stable bleaching compositions being particularly preferred. These may be both alkali-stable substances or components stabilized by suitable processes, for example by surface coating or passivation.

Optional ingredients are other typical detergent ingredients, for example defoamers (such as silicone oils, paraffins or waxes for example), dyes or alkali-stable perfumes. Low-foaming surfactants, above all nonionic surfactants, may also be present in a quantity of up to 5% by weight. Extremely low-foaming compounds are normally used. Such compounds preferably include $C_{12-18}$ alkyl polyethylene glycol polypropylene glycol ethers containing up to 8 moles of ethylene oxide and propylene oxide units in the molecule. However, other nonionic surfactants known as low-foaming surfactants may also be used, including for example $C_{12-18}$ alkyl polyethylene glycol polybutylene glycol ethers containing up to 8 moles of ethylene oxide and butylene oxide units in the molecule and end-capped alkyl polyalkylene glycol mixed ethers. It is particularly emphasized in this regard that the detergents according to the invention are capable of performing their function without these ingredients.

Although abrasive ingredients may be present in principle, the detergents according to the invention are preferably free from abrasive ingredients.

Although thickeners such as, for example, swellable layer silicates of the montmorillonite type, bentonite, kaolin, talcum or carboxymethyl cellulose, may also be present as optional ingredients to vary the viscosity, they are not necessary for achieving the required paste-form properties or the viscosities of the detergents according to the invention, in other words there is no need to add such thickeners.

The present invention is also concerned with the thickening effect of the compounds corresponding to formulae I and II with respect to sodium hydroxide.

On the one hand, the invention also relates to the use of compounds corresponding to formula I and/or II as thickeners in water-containing machine dishwashing detergents containing sodium hydroxide. These water-containing detergents may also contain builders.

On the other hand, the invention also relates to a process for thickening aqueous 42 to 55% by weight NaOH solutions. The process is characterized in that a compound corresponding to formula I and/or a compound corresponding to formula II is/are added with stirring to a corresponding NaOH solution to establish a paste-like consistency. The process is generally carried out at 20° C. to 25° C.

Since the solubility of NaOH in water increases at relatively high temperatures, the NaOH content of the aqueous solution may even exceed 55% by weight under those conditions. Correspondingly, the NaOH content may even be below 42% by weight at relatively low temperatures. Accordingly, the limitation to 42–55% by weight NaOH solutions is essentially confined to temperatures of 20° C. to 25° C.

In one preferred embodiment, the paste-form preparation is stirred for at least 3 minutes after the compounds corresponding to formula I and/or II have been added.

If the thickened paste-form preparation is intended to contain builders, they may be present from the outset in the NaOH solution to be thickened. However, the builders are preferably added to the already thickened paste-form preparation. Other ingredients optionally present are also preferably added to the already thickened paste-form preparation.

The paste-form preparations may be used as detergents, for example, by spraying water onto the paste-form detergent accommodated in a bucket (holding capacity 0.5 to 10 kg for example) and using the detergent thus dissolved in this form, for example introducing it into a dishwashing machine. For example, a dispenser of the type marketed by Henkel Hygiene GmbH under the name of Topmate® P40 may be used for this purpose. The detergent may also be added from a 200 liter drum, for example via a Lang Compactomix dispenser.

The paste-form detergent according to the invention may be directly produced in the containers used, for example in the drums in which it is sold. However, a relatively large quantity of detergent according to the invention may also be prepared in a stirred tank and then—depending on its viscosity—converted into a free-flowing state, optionally with gentle heating, for example to 45–50° C., packed in the container used, for example a drum, and then left to cool to around 20° C. to reach the viscosity according to the invention.

EXAMPLES

Detergents (1 kg) with compositions 1 to 3 below were prepared. 50% aqueous sodium hydroxide was initially introduced into a 2 liter glass beaker. 1,2-Propylene glycol was added with stirring (propeller stirrer, 700 r.p.m.) at 20° C., followed by stirring for 5 minutes after the addition. The solid components (builders), if any, were then added with stirring, followed by stirring for another 5 minutes after their addition. The viscosity measurements were carried out at 20° C. as described above 4 hours after production of the paste-form detergents. The values shown are the averages of three measurements. Since undissolved components with various particle sizes can be present in the paste-form detergents, viscosity variations of around ±20% are possible.

Detergent 1:
NaOH 34.0% by weight
1,2-Propylene glycol 2.0% by weight
Pentasodium tripolyphosphate 25.0% by weight
$Na_2CO_3$ 5.0% by weight
Water 34.0% by weight
Viscosity 24,000 mPa·s Detergent 2:
NaOH 31.25% by weight
1,2-Propylene glycol 2.5% by weight
Trisodium citrate 25.0% by weight
$Na_2CO_3$ 10.0% by weight
Water 31.25% by weight
Viscosity 22,000 mPa·s Detergent 3:
NaOH 33.5% by weight
1,2-Propylene glycol 3.0% by weight
Nitrilotriacetate 20.0% by weight
Sodium metasilicate 10.0% by weight
Water 33.5% by weight
Viscosity 39,000 mPa·s Detergent 4:
NaOH 47.5% by weight
1,2-Propylene glycol 5.0% by weight
Water 47.5% by weight
Viscosity 21,000 mPa·s Detergent 5:
NaOH 45.0% by weight
1,2-Propylene glycol 10.0% by weight
Water 45.0% by weight
Viscosity 59,000 mPa·s Detergent 6:
NaOH 42.5% by weight
1,2-Propylene glycol 15.0% by weight Water 42.5% by weight
Viscosity 180,000 mPa·s
Detergent 7:
NaOH 40% by weight
1,2-Propylene glycol 20% by weight
Water 40% by weight
Viscosity 720,000 mPa·s
Detergent 8:
NaOH 35% by weight
1,2-Propylene glycol 30% by weight
Water 35% by weight
Viscosity >800,000 mPa·s
Viscosity at 35° C.: 163,000 mPa·s
Comparison Detergents with no Compound of Formula I or Formula II The comparison detergents were produced in the same way as described above for the detergents according to the invention, but without the addition of a compound corresponding to formula I or formula II.

| | C1 | C2 | C3 | C4 |
|---|---|---|---|---|
| NaOH | 20% by weight | 25% by weight | 30% by weight | 35% by weight |
| Nitrilotriacetate | 30% by weight | 30% by weight | 20% by weight | 20% by weight |
| Soda calc. | 30% by weight | 20% by weight | 20% by weight | 10% by weight |
| Water | 20% by weight | 25% by weight | 30% by weight | 35% by weight |

C1 does not form a paste, but a moist lumpy powder.

C2, C3 and C4 undergo phase separation, i.e. separation of the aqueous phase, after storage for only 1 day at 25° C.

We claim:

1. A water-containing highly alkaline paste-form detergent comprising:

a) 15% to 50% by weight sodium hydroxide;

b) 16% to 55% by weight water; and c) 0.5% to 40% by weight of a compound of formula I:

$$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH(R^3)OR^4$ or a group $CH_2CH(R^5)OCH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups, or 0.5% to 40% by weight of a compound of formula II:

$$[HOCH_2CH(R^8)]_{3-x}NH_x \quad (II)$$

in which $R^8$ is a hydrogen atom or a methyl group and x is one of the numbers 0, 1 or 2, or 0.5% to 40% by weight of a mixture of compounds according to formulas I and II, wherein the weight ratio of compound (I), compound (II), or the mixture thereof to sodium hydroxide is less than 1, and the detergent has a pH value of at least 11.5 and a Brookfield viscosity at 20° C. of at least 15,000 mPa·s.

2. A detergent according to claim 1, comprising:

(a) 28% to 40% by weight sodium hydroxide;

(b) 28% to 40% by weight water; and (c) 1% to 10% by weight of a compound of formula I, a compound of formula II, or a mixture of compounds of formula I and formula II, wherein the detergent has a Brookfield viscosity at 20° C. of 15,000 mPa·s to 800,000 mPa·s.

3. A detergent according to claim 2, wherein the detergent has a Brookfield viscosity at 20° C. of 60,000 mPa·s to 250,000 mPa·s.

4. A detergent according to claim 1, further comprising up to 60% by weight of a builder.

5. A detergent according to claim 4, comprising 15% to 40% by weight of the builder.

6. A detergent according to claim 5, wherein the builder is selected from the group consisting of pentasodium triphosphate, trisodium citrate, nitrilotriacetate, ethylenediamine tetraacetate, and mixtures thereof.

7. A detergent according to claim 1, wherein the compound of formula I is selected from the group consisting of ethylene glycol, 1,2-propylene glycol, butyl glycol, and butyl diglycol, and the compound of formula II is selected from the group consisting of ethanolamine, diethanolamine, and triethanolamine.

8. A detergent according to claim 7, wherein the compound of formula I is 1,2-propylene glycol, and the compound of formula II is diethanolamine.

9. A method of thickening a water-containing detergent having a pH of at least 11.5 and comprising sodium hydroxide and 16% to 55% by weight water, said method comprising adding to the detergent a compound of formula I $$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH(R^3)OR^4$ or a group $CH_2CH(R^5)OCH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups, a compound of formula II $$[HOCH_2CH(R^8)]_{3-x}NH_x \quad (II)$$

in which $R^8$ is a hydrogen atom or a methyl group and x is one of the numbers 0, 1 or 2, or a mixture of compounds of formula I and formula II, wherein the weight ratio of compound (I), compound (II), or the mixture thereof to the sodium hydroxide is less than 1.

10. A method according to claim 9, wherein the compound (I), compound (II), or mixture thereof is added in an amount of 0.5% to 40% by weight of the detergent.

11. A method according to claim 10, wherein the detergent comprises up to 60% by weight of a builder component selected from the group consisting of pentasodium triphosphate, trisodium citrate, nitrilotriacetate, ethylenediamine tetraacetate, soda, alkali metasilicate, and mixtures thereof.

12. A method according to claim 11, wherein the detergent comprises up to 50% by weight of the builder component.

13. A method according to claim 9, wherein the compound of formula I is 1,2-propylene glycol, and the compound of formula II is diethanolamine.

14. A process of thickening an aqueous solution having a pH of at least 11.5 comprising 42% to 55% by weight sodium hydroxide 16% to 55% by weight water, said process comprising adding to the solution a compound of formula I $$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH(R^3)OR^4$ or a group $CH_2CH(R^5)OCH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups, a compound of formula II $$[HOCH_2CH(R^8)]_{3-x}NH_x \quad (II)$$

in which $R^8$ is a hydrogen atom or a methyl group and x is one of the numbers 0, 1 or 2, or a mixture of compounds of formula I and formula II, wherein the weight ratio of compound (I), compound (II), or the mixture thereof to the sodium hydroxide is less than 1.

15. A process according to claim 14, wherein the aqueous solution further comprises a builder.

* * * * *